United States Patent [19]

Collette

[11] 4,313,580

[45] Feb. 2, 1982

[54] SYSTEM FOR GUIDING REMOTE-CONTROLLED MISSILES

[75] Inventor: Hubert Collette, Neuilly-sur-Seine, France

[73] Assignee: Societe Nationale Industrielle Aerospatiale, Paris, France

[21] Appl. No.: 89,961

[22] Filed: Oct. 31, 1979

[30] Foreign Application Priority Data

Nov. 9, 1978 [FR] France ..... 78 13743

[51] Int. Cl.[3] ..... F41G 7/00

[52] U.S. Cl. ..... 244/3.13

[58] Field of Search ..... 244/3.13, 3.16

[56] References Cited

U.S. PATENT DOCUMENTS

| | | | |
|---|---|---|---|
| 2,930,894 | 3/1960 | Bozeman | 244/3.13 |
| 3,544,217 | 12/1970 | McEntyre | 244/3.13 |
| 4,143,836 | 3/1979 | Rieger | 244/3.15 |

FOREIGN PATENT DOCUMENTS

| | | | |
|---|---|---|---|
| 1050400 | 2/1959 | Fed. Rep. of Germany | 244/3.13 |
| 2801694 | 7/1979 | Fed. Rep. of Germany | 244/3.13 |

*Primary Examiner*—Sal Cangialosi

*Attorney, Agent, or Firm*—Merriam, Marshall & Bicknell

[57] ABSTRACT

The present invention relates to a system for guiding remote-controlled missiles, enabling these missiles to be fired by bursts, comprising a sighting device, an angular deviation measuring (ADM) device and a device for controlling the path; according to the invention, partial, individual and separate fields are defined in the field of the ADM device, said fields corresponding to various zones where successive missiles may be addressed, and said control device is designed for simultaneously guiding a plurality of missiles on a plurality of distinct predetermined standby courses spaced apart with respect to said line of sight. The invention finds particular application in the guiding of ground-ground, ground-air, or air-ground missiles.

9 Claims, 12 Drawing Figures

DISPLAY
6
7
CONTROL PANEL
COMPUTER
10
8
9
DATA PROCESSING AND CONTROL
DATA PROCESSING + CONTROL
REMOTE CONTROLS
15
16
LAUNCHING RAMPS
5
LAUNCHING RAMPS
17
18
REMOTE CONTROLS
11
12
1
3
2
4b
4a
13
14
SIGHTING + DETECTION ASSEMBLY
MULTIPLE ANG. DEV. MEAS.
THERMAL CAMERA
TELESCOPE
COLLISION A.D.M.
TAKEOVER A.D.M.

SYSTEM FOR GUIDING REMOTE-CONTROLLED MISSILES

The present invention relates to a system for guiding remote-controlled missiles, enabling these missiles to be fired by bursts. Not only does it enable a new system of missile guiding to be created, but also the socalled "single shot" firing systems, i.e. capable of guiding only one missile at a time to a target, to be easily converted into "multiple shot" systems.

Remote-controlled missile guiding systems are already known, which comprise a sighting device, of which the axis defines the line of sight, and an angular deviation measuring (ADM) device provided with missile locating means, for example of the infrared type. In these guiding systems, the missile is controlled, from its departure, to follow this line of sight, due to the indications which are furnished by the ADM device and which correspond to the deviations between the path actually followed by the missile and the ideal path represented by the line of sight. The control may be manual or automatic and the path correction orders sent to the missile are transmitted by wireless or by wire.

Such known systems are not capable of guiding a plurality of missiles at the same time. In fact, on the one hand, their ADM device is provided only to furnish angular deviation data of one missile at a time; on the other hand, due to their basic design which imposes the control of the path of a missile by the line of sight of the optical device, this missile partly conceals the target from the firer and if several missiles were fired at the same time, they would conceal one another. Furthermore, the flames emerging from the propulsion system of a missile, as well as the possible tracers, dazzle the firer, especially at night, this making it difficult, if not impossible, to see the target and distinguish different missiles which might follow adjacent paths close to the line of sight.

It is an object of the present invention to remedy these drawbacks.

To this end, according to the invention, the remote-controlled missile guiding system, comprising a sighting device of which the axis defines the line of sight, an angular deviation measuring (ADM) device provided with means for locating missiles in flight, and a control device obliging the missiles to follow a determined path due to the indications furnished by said ADM device, is noteworthy in that, in the field of the ADM device are defined partial, individual and separate fields corresponding to various zones where successive missiles may be addressed, with the result that this ADM device is multiple, i.e. capable of furnishing angular deviation data of a plurality of missiles in flight simultaneously, and said control device is designed simultaneously to guide, for at least the major part of their flight, a plurality of missiles on a plurality of distinct predetermined stand-by courses spaced apart with respect to said line of sight.

Thus, due to the fact that a plurality of different courses spaced apart with respect to the line of sight are provided, a plurality of missiles may be guided simultaneously, by knowing at each instant the position of each and without fear of dazzling. In fact, it is only at the end of flight that the path of each missile is controlled by the line of sight, up to impact on the target or at the point provided for the explosion of the charge carried.

A plurality of missiles may be fired successively, either at an automatic, regular rate, or as desired by the firer with a minimum interval; the firer aims and tracks a first target by manual or automatic control, then, as soon as the first missile has terminated its flight normally or accidentally, it seeks and tracks a second target whilst a second missile leaves its spaced-apart stand-by course and comes into position on the collision path adjacent the line of sight, and so on.

It is advantageous if the guiding system according to the invention comprises means for varying the position and transverse dimension of each of said partial fields as a function of the control orders addressed by the control device to the corresponding missile.

Consequently, particularly when the main ADM device is of the television type or associated with a thermal camera or imager, the electronic windows which serve to isolate the fields through which the various missiles are addressed and tracked, are monitored by electronic devices which take into account the orders which are addressed to each missile and the angular speeds of the line of sight for each window to move in the field of the ADM device, like the missile which corresponds thereto.

One of the advantages of such a monitoring is that it facilitates the tracking of a missile in the window which is allocated thereto and that if, for any reason, for example a cloak or jammer, the angular deviation data became erroneous, it would be possible to find the missile in the right window a few instants later without having to increase the dimensions thereof excessively.

The system according to the invention may use an ADM device comprising a large field in order to take over the missiles successively as soon as they depart and to control their path so that they are taken over successively, one by one, by the multiple ADM device.

The maximum firing rate may be determined at such a value that the first taking-over device only has to furnish the angular deviation of one missile at a time and the firer has the time to pass from one target to another and to track it. It is seen that the system according to the invention makes it possible to fire missiles in bursts on successive targets at a rate which is essentially determined by the time to re-aim from one target to the other and which is virtually independent of the duration of course of the missiles as they are placed on spaced-apart stand-by courses. These spaces apart courses may be offset or raised with respect to the line of sight, one missile at a time being placed on the collision course near the line of sight and only at the end of flight, thus reducing to a minimum the risk that the view of the target by the gun layer be hindered by dazzling or the smoke due to the propulsion systems and possible tracers of the missile.

An important advantage of the present invention is that it is possible, with raised stand-by courses, to begin firing over a cloak and thus limit the time of exposure of the gun layer. Another advantage is that the missiles do not need to be particularized and that they are all identical.

In the case of the sighting device comprising, in known manner, a thermal camera or imager, the multiple angular deviation measuring (ADM) device capable of furnishing the angular deviation data of a plurality of missiles simultaneously in flight, advantageously uses the optical system and the scanning system of said thermal camera. It then further comprises, on the one hand, either a supplementary thermal cell used for detecting the missiles, or detector elements placed on the same Dewar flask as the detection elements necessary for the thermal imagery and, on the other hand suitable electronic circuits for furnishing the angular deviation data of the missiles. The cell or the detector elements used for detecting missiles may use an infrared detection band identical to or different from that of the detectors of the thermal imagery. One of the advantages of such a system is that the problem of parallelism between the ADM devices and the thermal camera for tracking the targets is easily solved as the same optical system and the same scanning device are used for viewing the target and for measuring the angular deviations of the missiles. Another advantage of the system is that, if a thermal camera is added to a single-shot firing system capable of firing during the day, said thermal camera being for night vision and/or when visibility is poor, said system can, due to the invention, fire by bursts by day and by night without adding supplementary optical devices.

In the guiding system according to the invention, the multiple angular deviation measuring device may be used both for controlling the missiles on the predetermined spaced apart stand-by courses, then for controlling them at the end of course on the final path.

However, it is preferable if said multiple ADM device successively addresses, the missiles in final phase, in an ADM device with relatively narrow field, ensuring the successive control of the missiles on the final path in the vicinity of the line of sight, it being understood that the taking-over paths and the spaced apart stand-by courses are determined so that the missiles remain outside the field of the narrow-field ADM device.

Thus, only a precision and a range of angular deviation measurement limited to the relatively reduced requirements of control on predetermined spaced-apart stand-by courses, are required of the multiple ADM device, and only the ADM device with narrow field, which takes over only one missile at a time, must have the performances of precision and of range required for the final path.

Furthermore, this results in another important advantage in that, to convert an existing single shot system comprising an ADM device for taking over and another for the terminal phase of the flight, into a system capable of firing by bursts, it suffices to add to it an ADM device capable of giving the angular deviations of a plurality of missiles, with range and precision requirements reduced to those necessary for the predetermined spaced apart stand by courses; the existing take-over ADM device is used for addressing the missiles in the windows of the new ADM device, which is used for controlling the various missiles on predetermined standby courses and for addressing them, in final phase, in the field of the narrow-field ADM device which ensures the successive control of the missiles on the final path in the vicinity of the axis of sight.

This advantage is particularly interesting when there is added to a single shot system an ADM device associated with a thermal camera, or imager, as indicated hereinabove. A single shot system capable solely of firing in day time may thus be given a new capacity for burst firing at night and/or in poor visibility up to ranges equal to those of the added thermal camera, whilst maintaining, during daytime and with good visibility, the performances of the initial single shot system.

According to another aspect of the invention, if the multiple ADM device is constituted by a device based on a television camera or ADM device associated with a thermal camera, due to the system of windows which isolate parts of the field of vision and by determining the take-over paths and the spaced apart standby courses so that they are relatively far from the target zone, the target zone may be isolated by another device, and the target may be automatically tracked by suitable electronic devices, whilst being hindered to a minimum by the presence of the missiles.

In the case of the orders being addressed to the missile via wires or any other known system of link, a device may be used for automatically determining the instant when the missile must pass from a spaced apart stand-by course to the final path, which by suitable means, detects the break of the link with the preceding missile, at the end of its normal flight or interrupted accidentally.

The invention will be more readily understood on reading the following description with reference to the accompanying drawings, in which.

Figure 1:
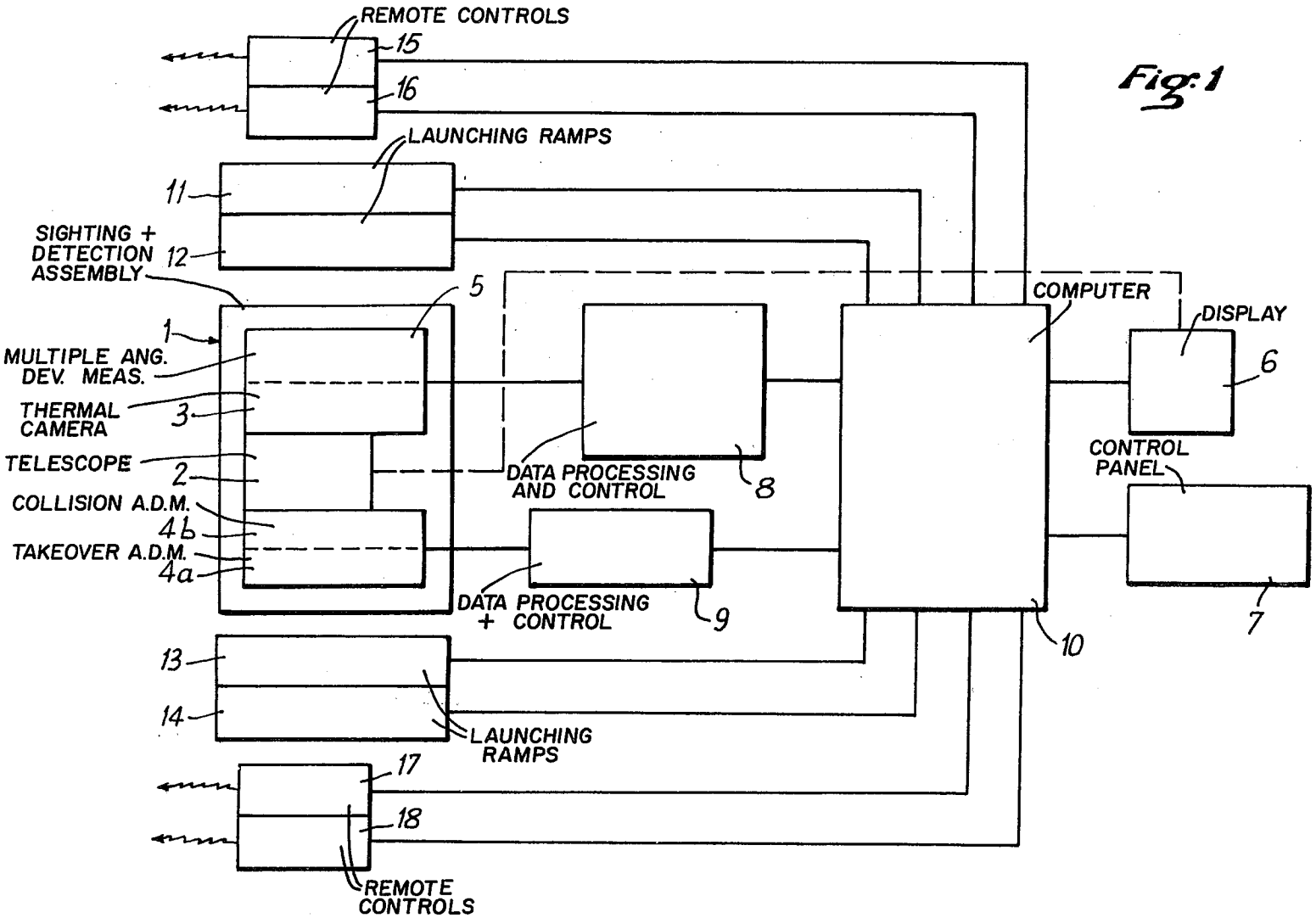
FIG. 1 is a block diagram of an example of a system for firing remote controlled missiles in bursts, according to the invention.
Figure 7:
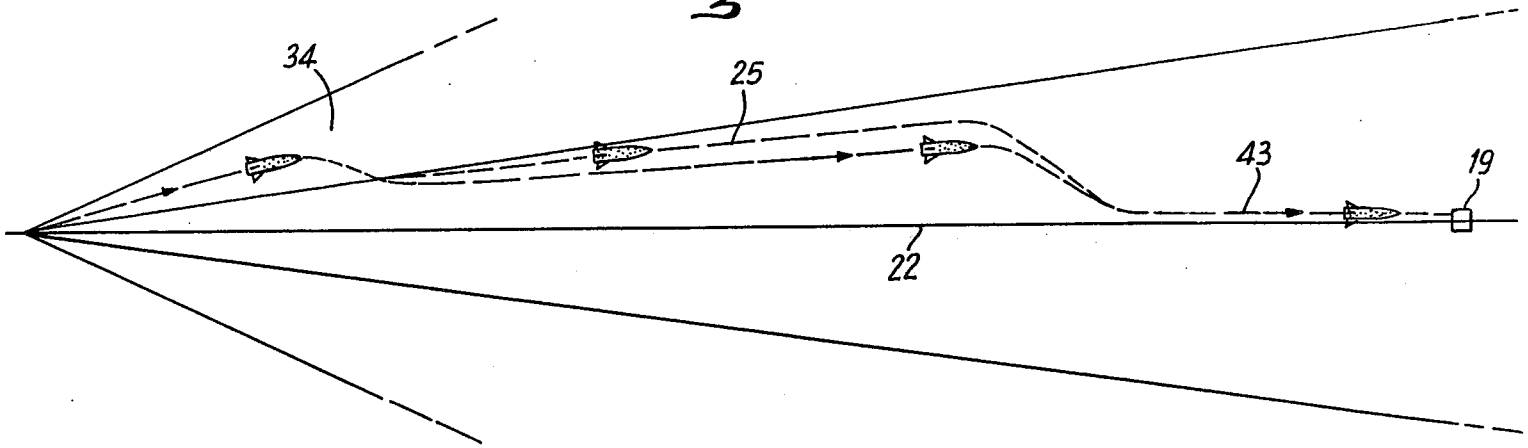

FIG. 7 schematically illustrates a variant of the device of FIG. 1.

Figure 8:
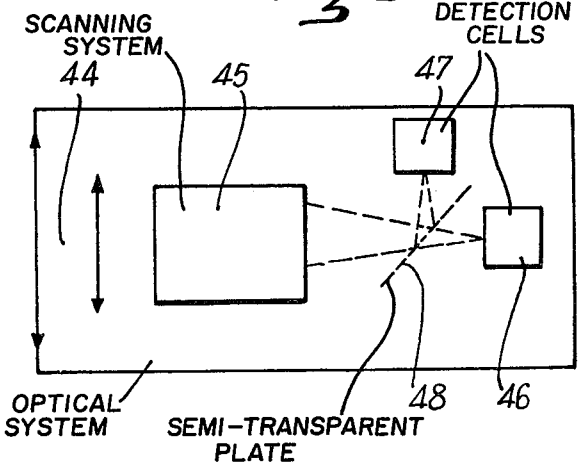

FIG. 8 shows the diagram of an embodiment of the main angular deviation measurement (ADM) device according to the invention.

Figure 9:
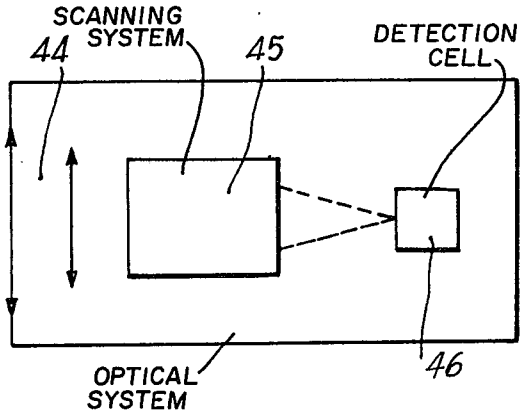

FIG. 9 schematically illustrates a variant embodiment of the main ADM device according to the invention.

Figure 10:
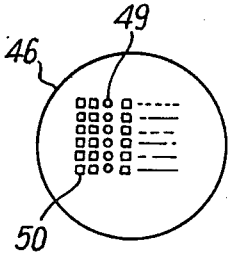

FIG. 10 shows a detail of the device of FIG. 9.

Figure 11:
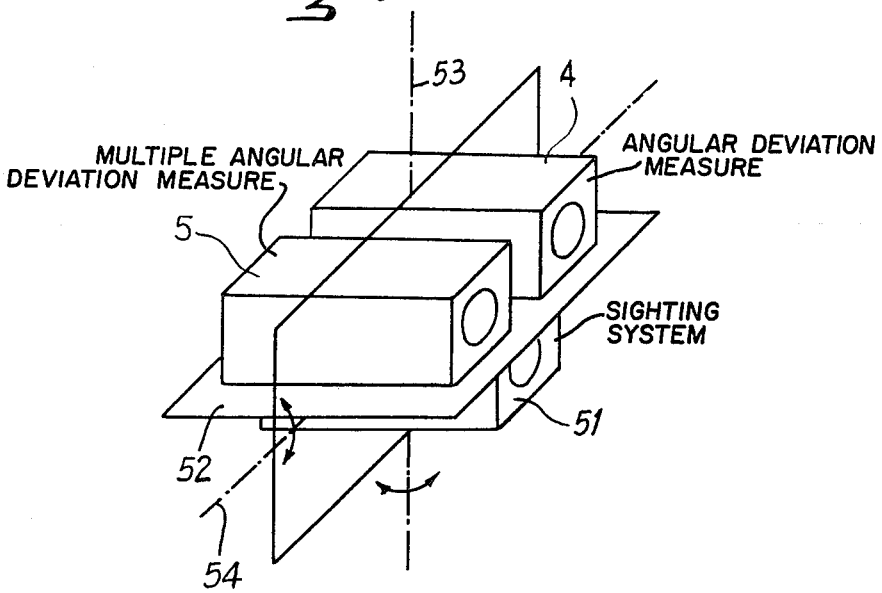
Figure 12:
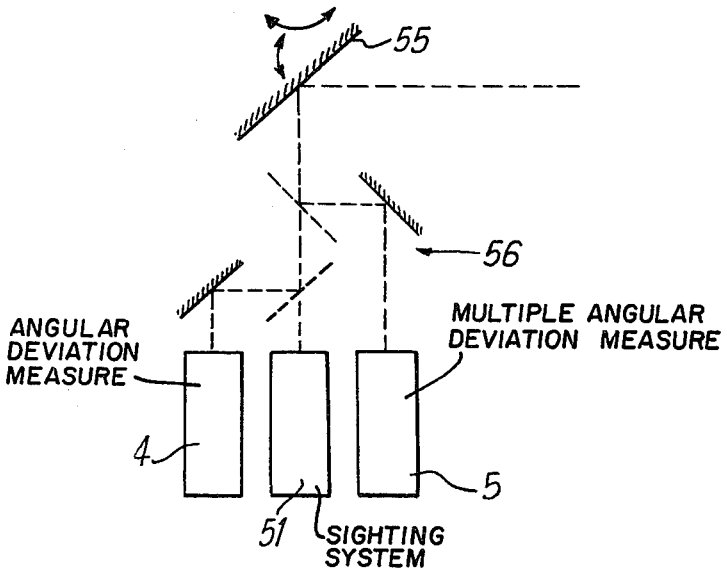

FIGS. 11 and 12 show two schematic embodiments of a sighting and detection assembly according to the invention.

In these Figures, like references designate like elements.

Referring now to the drawings, FIG. 1 shows, in the form of a block diagram, the organisation and links between the equipment of a system according to the invention for firing in bursts.

In the configuration chosen by way of example, the sighting and detection assembly 1 comprises a system for sighting and tracking targets constituted by an optical telescope 2, a thermal camera or imager 3, a system for detecting the missiles constituted by a take-over angular deviation measurement (ADM) device **4*a* and a collision ADM device 4*b*, as well as a multiple ADM device 5** built into the thermal camera.

The operator has at his disposal on the one hand, a display system 6 consituted by the eye-piece of the optical telescope 2, in which may be visualized the image furnished by the thermal camera 3, and on the other hand, a control and monitoring panel 7 on which are grouped the controls and monitors relative to the sighting and detection assembly, to the modes of functioning of the firing system and to the operation of the missiles.

The firing system further comprises:

the electronic box 8 of the thermal camera 3 and of the multiple ADM device 5 of which the functions are as follows:

processing, in known manner, of the thermal data from the camera for generation and sending of a video signal towards the display system;

processing of the data from the multiple ADM device for furnishing the computer with the relative angular variation measurements of the missiles with respect to the reference axes;

generation and control of the windows as a function of the data furnished by the computer.

the electronic box 9 of the take-over and collision ADM devices 4*a*, 4*b* which delivers the angular deviation measurement of a missile in question, from the data furnished by the actual ADM device;

a computer 10 of which the functions are explained hereinbelow;

launching ramps 11, 12, 13 and 14 for the missiles;

remote control boxes 15, 16, 17 and 18 for sending orders to the missiles.

Figure 2:
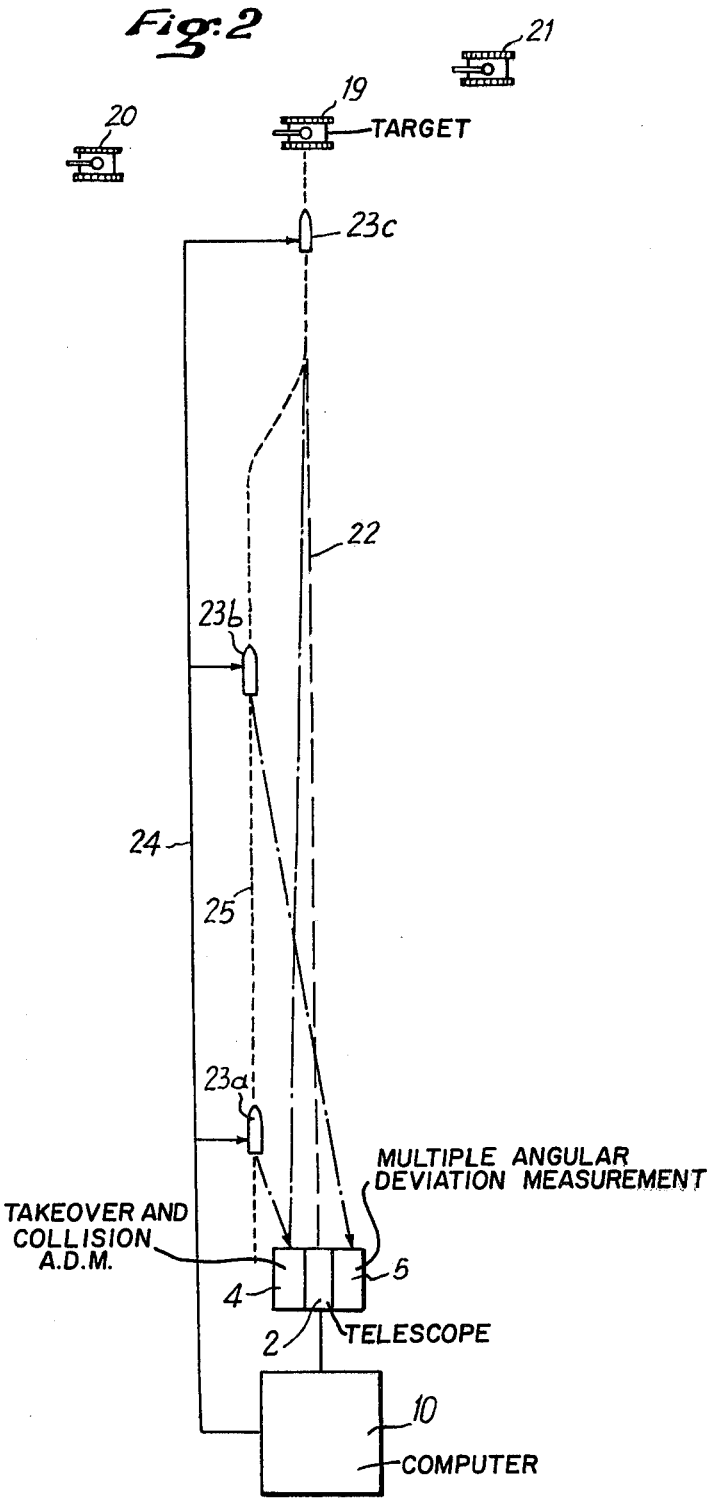
FIG. 2 is a schematic and partial plan view of the device of FIG. 1, in an example of firing configuration.

The firing system according to the invention functions in the manner illustrated diagrammatically in FIG. 2. The operator begins by aiming the sighting system 2 on a target, for example a tank 19 chosen from among two others 20 and 21, with the aid of a reticle materialized on the image, then he maintains the line of sight 22 on this target. He then controls the firing of a first missile 23 in known manner.

In accordance with the invention, this missile is firstly taken into account by the take-over ADM device 4*a* (position 23*a*). From the angular deviation measurement furnished by this system, the computer 10 elaborates the orders sent to the missile via a link 24, for example by wireless or by wire, to bring it in the field of the multiple ADM device 5. The missile is then (position 23*b*) taken into acocunt by this system and maintained on a standby course 25 spaced apart from the line of sight, until it is returned to the line of sight, at a certain distance from the target, said distance determined for example from telemetric information furnished by a known system (not shown).

From this point and up to the end of the flight (position 23*c*), the missile is taken into account by the narrow field ADM device 4*b*.

As soon as the first missile is taken into account by the multiple ADM device 5, it is possible to fire a second missile and to guide it onto another spaced-apart stanby course, and so on.

When the first missile has reached its target, the operator aims the line of sight on another target (for example one of tanks 20 and 21) towards which the second missile is directed, according to the above-described process, and so on.

Figure 3:
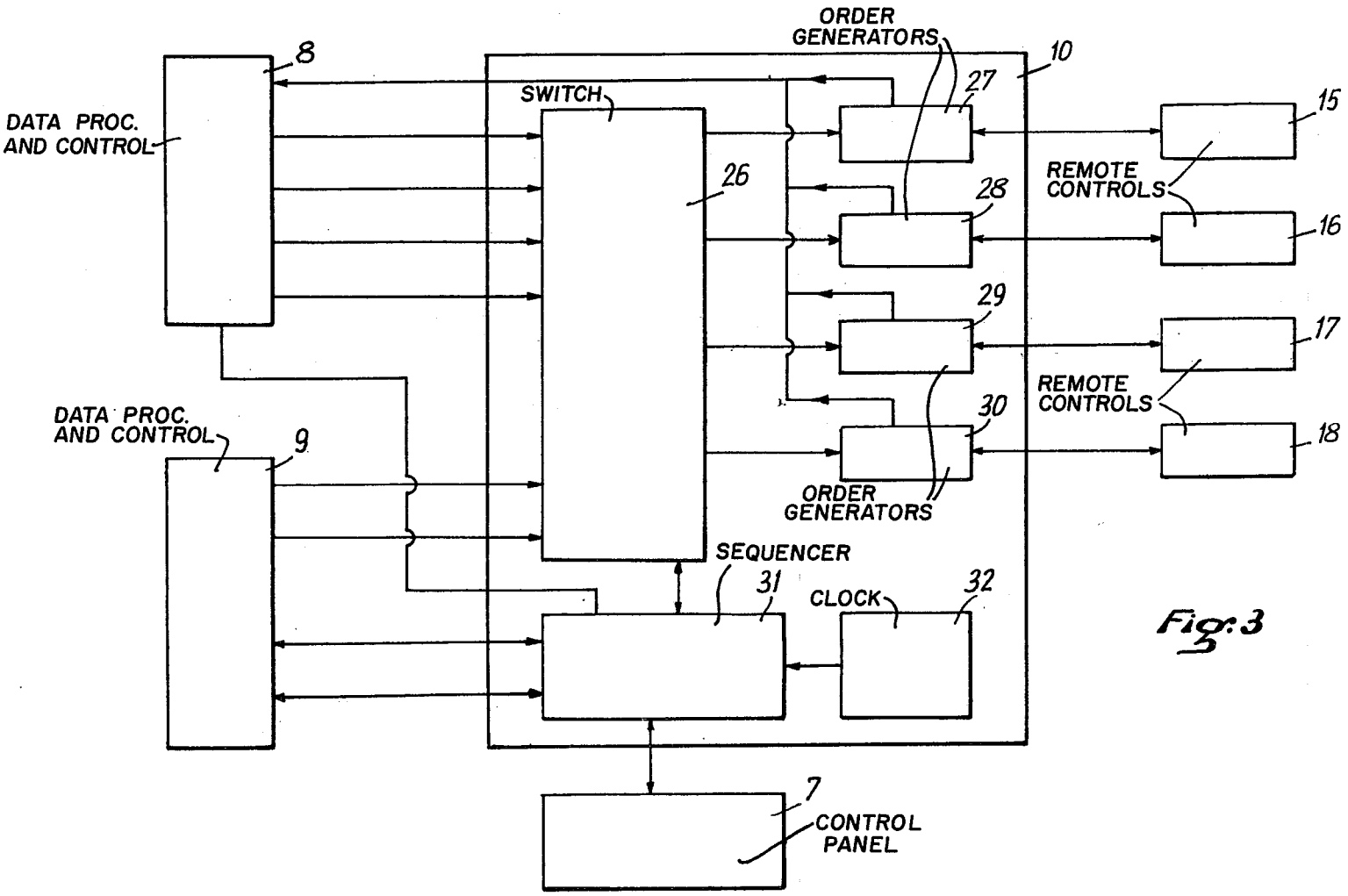
FIG. 3 is a block diagram of the computer of the firing system of FIGS. 1 and 2.

FIG. 3 schematically shows the functional organisation of the computer, concerning the processing of the angular deviation measurements. The secondary functions such as the control of the launching ramps or the supply of the sub-sets do not form part of the invention and are therefore not described.

The computer 10 comprises:

a switch and dispatcher of angular deviation measurements (26) whose role is to furnish to each of a plurality of order generators (27,28,29 and 30), the angular deviation measurement relative to the corresponding missile from the angular deviation measurements furnished by the take-over and collision ADM devices 4*a* and 4*b* and by the multiple ADM device 5, via electronic boxes 8 and 9;

a sequencer 31 whose essential function is to determine the instants of switching of the angular deviation measurements as a function of the information furnished by the operator via the control panel 7 (number of missiles to be fired, rate of firing), by the ADM devices 4*a*, 4*b* and 5 (input signal in the field, output signal from the field) and possibly by other equipment (distance of the target);

a clock 32 furnishing the sequencer 31 with a time base;

the order generators 27,28,29 and 30 (there are as many order generators as there are missiles which may be fired by bursts) which convert the angular deviation measurement signal into an order adapted to the corresponding missile as a function of the initial firing conditions and of the information relative to the missile itself and which, for this, are connected to the remote control devices 15 to 18.

Figure 4:
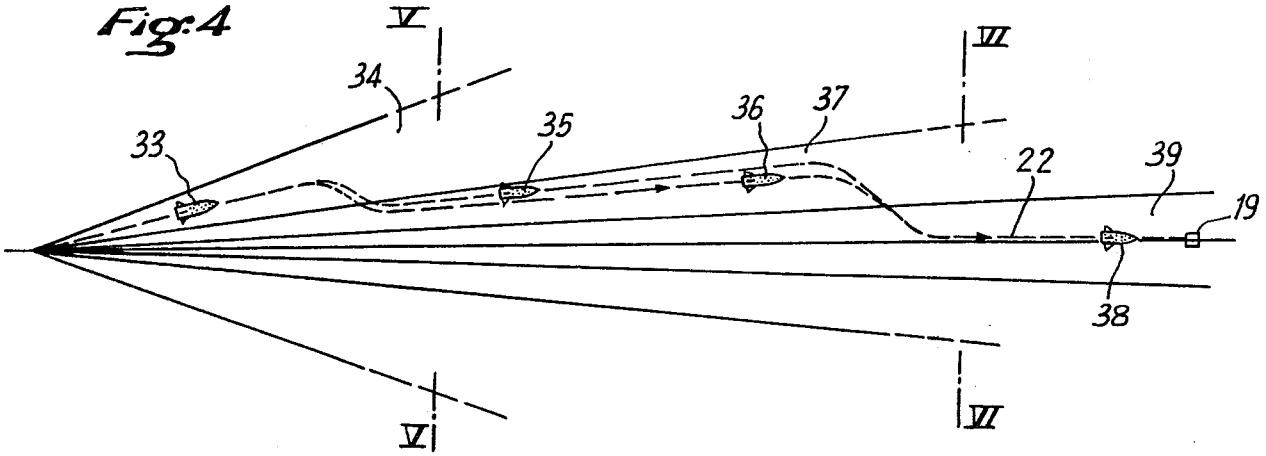
FIG. 4 is a schematic side view of the firing configuration described with regard to FIG. 2.

FIG. 4 shows the relative position of the missiles in the fields of the ADM devices. In the configuration shown in this Figure, a missile 33 has just been fired; it is taken into account by the take-over ADM device 4*a* in the corresponding field 34. The missiles 35 and 36 fired previously are on spaced apart standby courses in the field 37 of the multiple ADM device 5. Finally, the first missile fired 38 is aligned on the line of sight 22 and taken into account by the narrow-field ADM device 4*b* in the corresponding field 39.

Figure 6:
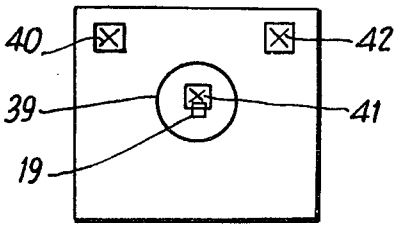
FIGS. 5 and 6 are respectively, schematic views along the transverse planes V—V and VI—VI of FIG. 4, at different instants.
Figure 5:
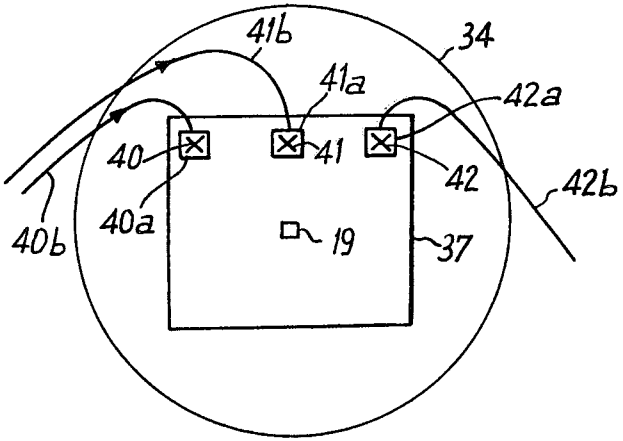

FIGS. 5 and 6 are sections of FIG. 4 at different instants.

FIG. 5 shows the field 34 of the take-over ADM device 4*a*, the field 37 of the multiple ADM device 5 and the target 19. At the instant in question, three missiles 40, 41 and 42 are on spaced apart standby courses in windows 40*a*, 41*a* and 42*a*, after having followed the take-over paths 40*b*, 41*b* and 42*b*.

At the instant considered in FIG. 6, the first missile fired (41) is located in the field 39 of the ADM device 4*b* and will reach its target 19. The other two missiles 40 and 42 remain on standby on spaced apart courses to destroy new targets.

FIG. 7 illustrates a variant of the invention according to which the multiple ADM device 5 ensures the taking into account of the missiles on their standby course 25 spaced apart from the line of sight and on their final path 43.

FIGS. 8 and 9 illustrate two embodiments of the multiple ADM device when the sighting device comprises a thermal camera or imager. In both cases, the ADM device uses the same input optical system 44 and the same scanning system 45 as the thermal camera. The difference lies at the level of the detection cells.

In the first embodiment (FIG. 8), there is added to the detection cell 46 used for viewing the target, a cell 47 for detecting the missiles optically decoupled from the cell 46 by a device 48 constituted for example by a semi-transparent plate.

In the second embodiment (FIGS. 9 and 10), the detection elements 49 of the ADM device and the detection elements 50 of the thermal camera constitute a single cell 46 placed in one Dewar flask (not shown).

FIGS. 11 and 12 show two variant embodiments of the assembly 1 of FIG. 1. As shown in FIG. 11, an ADM device 4 serving simultaneously for initial taking over and for final flight, a multiple ADM device 5 and the sighting system 51 are mounted so that their axes are parallel on a mobile platform 52 which may rotate about axes 53 and 54. The tracking of the targets is effected by controlling the orientation of the platform so that the line of sight remains aimed on the target. To facilitate this operation, the platform may be stabilised.

In the variant embodiment of FIG. 12, the ADM devices 4 and 5 and the sighting system 51 are fixed and their axes are coupled via a mobile stabilised mirror 55 and a set of fixed mirrors 56, of which certain are semi-transparent. The tracking of the targets is effected by controlling the displacement of the mirror 55 so that the line of sight remains aimed on the target.

It will be noted that, due to the invention, it is possible to produce a system for firing remote-controlled missiles in bursts, operational by day in good visibility at the maximum range of the corresponding single shot system and operational by night and/or in poor visibility at a reduced range, by adaptation and integration in and to an existing single shot system, which may be used by day in good visibility, of a multi-missile ADM device described hereinabove associated with the thermal camera of this system.

What is claimed is:

1. In a system for guiding remote-controlled missiles comprising a sighting device having an axis defining a line of sight, an angular deviation measuring (ADM) device provided with means for locating missiles in flight, and a control device (obliging) directing the missiles to follow a predetermined path in accordance with indications furnished by said ADM device, the improvement comprising means for defining a plurality of partial, individual and separate fields in the field of the ADM device, said individual fields corresponding to various zones where successive missiles may be addressed, whereby said ADM device is multiple and capable of furnishing the angular deviation information of a plurality of missiles in flight simultaneously, said control device being designed to guide, simultaneously, for at least the major part of their flight, a plurality of missiles on a plurality of distinct, predetermined standby courses spaced apart with respect to said line of sight.

2. The guiding system of claim 1, wherein it comprises means for varying the position and the transverse dimensions of each of said partial fields as a function of the control orders addressed by the control device to the corresponding missile.

3. The guiding system of claim 1, wherein it comprises, in addition to the multiple ADM device, a large-field ADM device, to take over the missiles successively as soon as they depart and to control their path so that they are successively taken over, one by one, by the multiple ADM device.

4. The guiding system of claim 1, in which the sighting device comprises a thermal camera or imager including an optical system and a scanning system, wherein said multiple ADM device uses the optical system and the scanning system of said thermal camera.

5. The system of claim 4, wherein the multiple ADM device comprises a supplementary thermal cell used for detecting the missiles.

6. The system of claim 4, wherein the multiple ADM device comprises detector elements placed on the same Dewar flask as the detection elements necessary for the thermal imagery.

7. The system of claim 1, wherein it comprises, in addition to the multiple ADM device, an ADM device with relatively narrow field, ensuring the successive control of the missiles on the final path in the vicinity of the line of sight.

8. The system of claim 7, wherein the various ADM devices and the sighting device are mounted on the same platform so that their axes are parallel, said platform being pivotable in order to be able to follow a target.

9. The system of claim 7, wherein it comprises a system of mirrors rendering the axes of the various ADM devices, and the sighting device parallel, the tracking of a target being effected due to at least one mobile mirror.

* * * * *

UNITED STATES PATENT AND TRADEMARK OFFICE

CERTIFICATE OF CORRECTION

PATENT NO. : 4,313,580

DATED : February 2, 1982

INVENTOR(S) : HUBERT COLLETTE

It is certified that error appears in the above-identified patent and that said Letters Patent are hereby corrected as shown below:

Cover page, under Foreign Priority Data [30], the French application number should be

--78 31743--

Signed and Sealed this

*Fourteenth* Day of *September 1982*

[SEAL]

*Attest:*

GERALD J. MOSSINGHOFF

*Attesting Officer*

*Commissioner of Patents and Trademarks*